United States Patent [19]

Oda et al.

[11] 4,279,029

[45] Jul. 14, 1981

[54] ELECTRONIC TIMEPIECE

[75] Inventors: Hajime Oda; Masanori Fujita; Nakanobu Moritani, all of Tokyo, Japan

[73] Assignee: Kabushiki Kaisha Seikosha, Tokyo, Japan

[21] Appl. No.: 87,750

[22] Filed: Oct. 24, 1979

[30] Foreign Application Priority Data

Oct. 26, 1978 [JP] Japan ..... 53/131896

[51] Int. Cl.[3] ..... G04B 19/24; G04B 23/02; G04C 9/00

[52] U.S. Cl. ..... 368/29; 368/73; 368/187; 368/251

[58] Field of Search ..... 58/4 A, 38 A, 38 R, 58/39.5, 57.5, 152 B; 368/28, 29, 34, 72–74, 185–187, 250, 251

[56] References Cited

U.S. PATENT DOCUMENTS

| | | | |
|---|---|---|---|
| 4,074,516 | 2/1978 | Kondo | 58/57.5 |
| 4,162,610 | 7/1979 | Levine | 58/148 |

*Primary Examiner*—Vit W. Miska

*Attorney, Agent, or Firm*—Robert E. Burns; Emmanuel J. Lobato; Bruce L. Adams

[57] ABSTRACT

An electronic timepiece in which scheduled time data on specified date or on specified day of the week are set into a counter and their contents are displayed. When the scheduled time comes, an alarm sound is generated. If specific data are inserted instead of the instruction data representative of the date or the day of the week, the timepiece generates the alarm sound repeatedly at the scheduled time. A number of scheduled contents can be set using the same circuit construction and set action for generating repeatedly the alarm sound can be made easily.

2 Claims, 3 Drawing Figures

ELECTRONIC TIMEPIECE

BACKGROUND OF THE INVENTION

This invention relates to an electronic timepiece capable of generating an alarm sound and more particularly to an electronic timepiece capable of setting a number of scheduled contents using a simple circuit construction and capable of repeatedly generating the alarm sound by means of a simple set action.

There has conventionally been available an electronic timepiece having to function of setting data such as the scheduled date, hour and minute to a register so as to generate an alarm sound when the scheduled time comes, and the function of generating the alarm sound every day when the scheduled time comes. These functions, however, have been carried out by using separate circuits, and time data is also made by first manipulating a selector switch for selecting the function modes and then setting desired data corresponding to the mode into counters.

SUMMARY OF THE INVENTION

It is one object of the present invention to provide a novel electronic timepiece.

It is another object of the present invention to provide an electronic timepiece which, when a scheduled time of at least one of date/day of the week and other scheduled contents is set, is able to display the scheduled time, to carry out time adjustment while confirming not only the display of the time but also that of the date/day of the week, and to store a number of scheduled times by using the same circuit construction.

It is a further object of the present invention to provide an electronic timepiece in which the setting of the scheduled time data is rapidly carried out with a simple construction by use of pulses generated in response to manual operation of a switching device and which enables the setting of a number of scheduled time data in the same function mode.

It is yet another object of the present invention to provide an electronic timepiece which, when an alarm sound is to be generated whenever a scheduled set time comes, maintains the scheduled time under the set state even after generation of the alarm sound, and when generation of the alarm sound is not necessary any longer, enables to clear the scheduled time data, thereby eliminating the necessity of setting repeatedly the same time.

BRIEF DESCRIPTION OF THE DRAWINGS

The nature of the invention as well as other objects and advantages thereof will become more apparent from consideration of the following detailed description and the accompanying drawings in which.

DESCRIPTION OF THE PREFERRED EMBODIMENTS

Figure 1A:
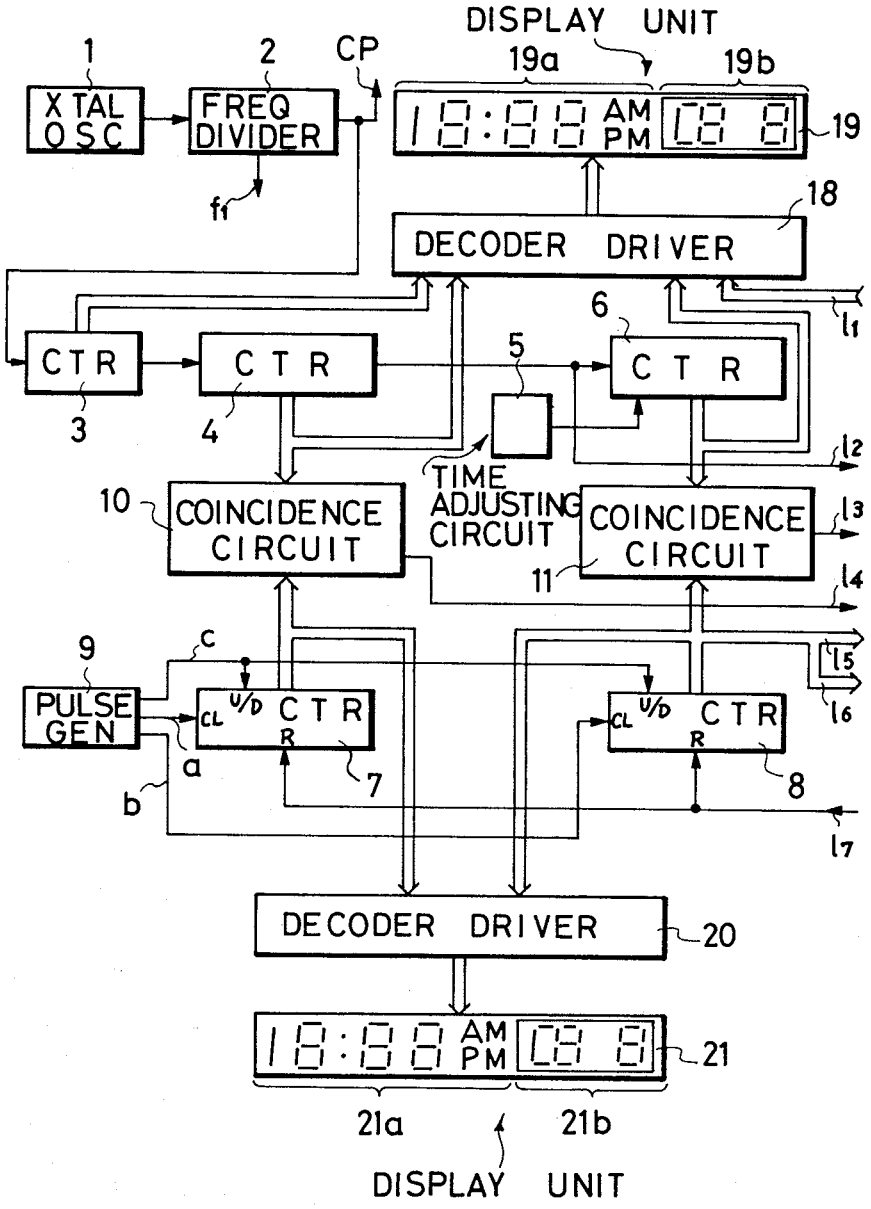
FIGS. 1A and 1B are block diagrams each showing an electric circuit of an embodiment of the present invention.
Figure 1B:
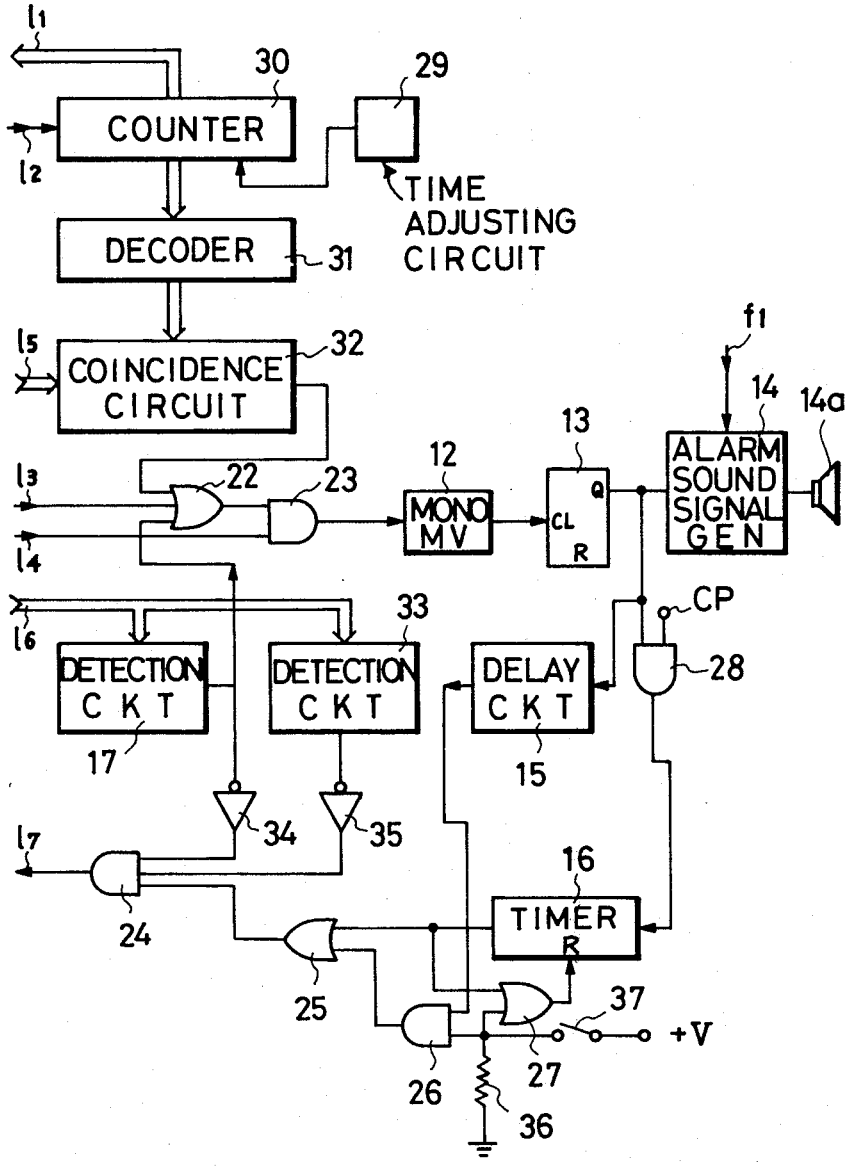

A preferred embodiment of the invention will now be explained with reference to the accompanying drawings. In FIGS. 1A and 1B, the output frequency of a crystal oscillator 1 is lowered into two kinds of frequencies by a frequency divider 2, whose signals are illustrated as a symbol $C_p$ and $f_1$, respectively. Among them, the signal $C_p$ which has a frequency of 1 Hz, is applied as an input to a counter 3 for counting a second digit. The carry output of this counter is fed into a counter 4 for hour and minute digits and its carry output is in turn fed into a counter 6 for date digit. A reference numeral 5 denotes a time adjusting circuit which is customarily used.

An up/down counter 7 counts and stores data of hours and minutes that are to be set in advance while an up/down counter 8 counts and stored data of a date and a day of the week that are to be similarly set in advance. In the embodiment, these counters 7 and 8 are of a 39-notation type. A pulse generator 9 generates pulses as it is manually operated, and its detailed construction will be explained elsewhere with reference to FIGS. 2 and 3. A concidence circuit 10 compares the output of the counter 4 with that of the counter 7 and generates a coincidence signal when they coincide with each other, and a coincidence circuit 11 compares the output of the counter 6 with that of the counter 8 and generates a coincidence signal when they coincide with each other.

Mono-multivibrator 12 triggers a flip-flop circuit 13, and when its output Q becomes a logic value "1" (hereinafter called "1"), an alarm sound generator 14 generates an alarm sound signal. Reference numerals **14*a* denotes a speaker. Delay circuit 15 retards an input signal by a prescribed time. A timer 16, when pulses are applied to an input terminal thereof, counts for a predetermined time and thereafter generates an output "1". A detection circuit 17 generates an output "1" when the output of the counter 8 is "00". A decoder driver 18 converts time date of the counters 3, 4, 6 and 30 into signals suitable for display on a display unit 19 and a decoder driver 20 converts time data of the counters 7 and 8 into signals suitable for display on a display unit 21**.

The display unit 21 consists of a display section **21*a* forming a display pattern of each of time and AM,PM and a display section 21*b* forming display patterns capable of displaying each of a date of two-digits and English abbreviations of days of the week, i.e., SU, MO, TU, WE, TH, FR and SA. Display sections 19*a* and 19*b* of the display unit 19 have the same construction as the display sections 21*a* and 21*b*, respectively. Reference numerals 22 through 28 denote gate circuits, respectively. A time adjusting circuit 29 is a conventional time adjust circuit for correcting the counter 30 for a day of the week. A decoder 31 is a circuit which converts the output of the counter 30 into a signal that can be compared with that of the counter 8. Reference numeral 32 denotes a coincidence circuit. Detection circuit 33 for a day of the week generates an output "1" when it determines that the output of the counter 8 represents a day of the week. Reference numerals 34 and 35 denote inverters, respectively, reference numeral 36 is a resistor and 37** is a switch.

Figure 2:
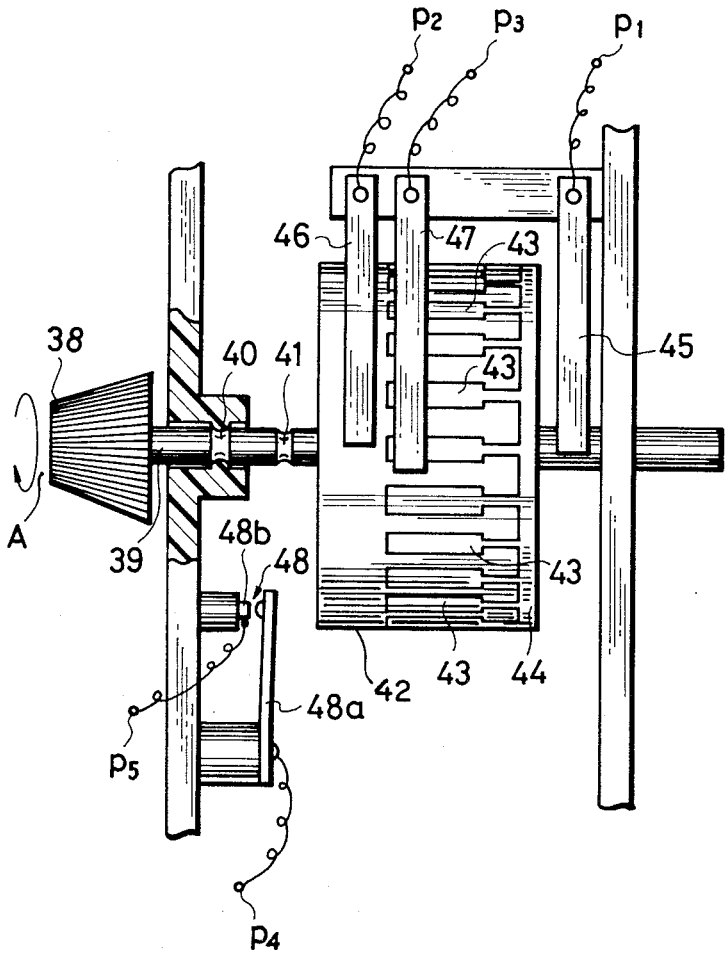
FIG. 2 is a partially cut-away side view of a switch showing a part of the abovementioned embodiment.
Figure 3:
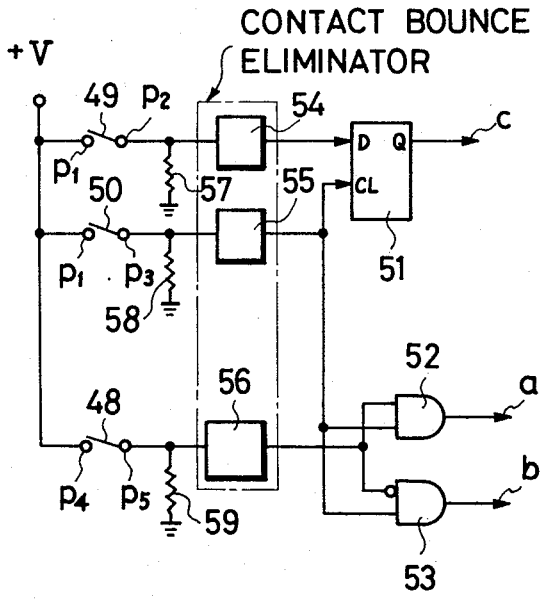
FIG. 3 is a block diagram showing in detail a pulse generator used in the abovementioned embodiment.

FIGS. 2 and 3 illustrate an example of the pulse generator 9, respectively.

Referring to FIG. 2, a knob 38 is secured to a shaft 39, on which are formed click grooves 40 and 41. A rotary member 42 is also secured to the shaft 39, and an electrode 43 is connected to the shaft 39 via an extension electrode 44 and is wired to a power supply via a contact 45 that comes into contact with the shaft 39, and via a terminal $P_1$. Tips of contacts 46 and 47 are deviated considerably from each other in the direction of rotation of the rotary member 42 and are allowed to come into, and out of, contact with the electrode 43. The contacts 46 and 47 are grounded via terminals $P_2$, $P_3$ and resistors, respectively. Movement of the rotary member 42 in the axial direction closes the switch 48. Its contact 48*a* is wired to the power supply via a terminal $P_4$ while its other contact 48*b* is grounded via a terminal $P_5$ and a resistor.

In FIG. 3, switches 49 and 50 consist of the contact 46 and electrode 43, and the contact 47 and electrode 43, respectively, that are shown in FIG. 2. Reference numeral 51 is a flip-flop circuit; 52 and 53 are gate circuits; 54 through 56 are contact bounce eliminators; and 57 through 59 are resistors.

Next, the an explanation will be given on the pulse generating action of the pulse generator 9 in the abovementioned construction.

Initially, when the knob 38 in FIG. 2 is pushed in as shown, the switch 48 is closed to open the gate circuit 53. As the knob 38 is turned in the direction of an arrow A, the switch 49 is turned on and off earlier than the switch 50. Accordingly, the output C of the flip-flop circuit 51 becomes "1", thereby placing the counters 7 and 8 in the up-count mode. The switching pulse of the switch 50 is produced on the output terminal b of the gate circuit 53 in this instance. When the knob is turned in the reverse direction, the output terminal C of the flip-flop circuit 51 becomes "0", thereby placing the counter 8 in the down-count mode. Hence, the pulse is generated on the output terminal b. Under the state where the knob is pulled out by one step, the switch 48 is closed and consequently, the gate circuit 53 is closed with the gate circuit 52 being open. Thereafter, in the same way as described above, the counter 7 is changed over to "up" and "down" due to "1" and "0" of the terminal C, and further pulses are produced at either one of the terminal a and b.

Next, an explanation will be made how the alarm sound signal generator 14 is actuated at the set time of a predetermined day of the week, e.g., at 10:15 a.m., Tuesday.

The pulse generator 9 shown in FIG. 1 is manually operated to produce a pulse on its terminal a so as to let the counter 7 count till the display unit 21*a* indicates 10:15 AM. After this setting action is finished, the pulse is generated on the terminal b and the counter 8 is caused to proceed counting. In this instance, the counter 8 sets various functions in accordance with its count values. First, when the set data of the counter is "00", that is to say, when the display of the display unit 21*b* is "00", the counter generates an alarm sound at a set time everyday. When the counter 8 counts the date within the range of 01 to 31 and the display section 21*b* displays that numeric value, the alarm sound is generated at a set time of that date. Further, when the counter 8 counts the number in the range of 32 to 38, it represents the day of the week and the display section 21*b* displays the abbreviations SU, MO, TU, WE, TH, FR and SA corresponding to the numeric values, respectively.

In this embodiment, the set day of the week is Tuesday. When the counter 8 is applied with 34 pulses, therefore, the display section 21*b* displays TU. On the other hand, the detection circuit 33 becomes "1" when a day of the week is set to the counter 8. In this case, "0" is produced on the output terminal of the inverter 35 and the gate circuit 24 is closed. In this manner, setting of the day of the week and the time is completed.

Meanwhile, the current time is counted by the counters 3, 4, the date by the counter 6 and the day of the week by the counter 30, respectively, and they are displayed by the display unit 19.

As the time passes by and the counter 30 counts Tuesday, the output of the decoder 31 becomes "34" and becomes in conformity with "34" set to the counter 8. Hence, "1" is produced from the coincidence circuit 32 and an input of the gate circuit 23 is held at that value. When the counter 4 counts 10:15 AM under this state, the counted value coincides with the set time of the counter 7 so that "1" is produced from the coincidence circuit 10. Accordingly, "1" is produced also in the gate circuit 23 and hence, a pulse is produced at the output of the mono-multivibrator 12 which is triggered by the gate circuit 23. In consequence, the flip-flop circuit 13 is thereby triggered and its output Q inverses to "1", whereby the alarm sound signal generator 14 is actuated and generates an alarm sound from the speaker 14*a*. To stop the sound in this case, the switch 37 is first closed and the flip-flop circuit 13 is reset via the gate circuit 27 so that the output Q is made "0" and the alarm sound generator 14 is thus deactivated.

Unless the switch 37 is operated, the gate circuit 28 is opened and a 1 Hz signal $C_p$ is fed to the timer 16 when the abovementioned output Q inverses to "1". When a predetermined time is counted under such a state, the output of the timer 16 becomes "1" so that the flip-flop circuit 13 is reset, thereby deactivating the alarm sound signal generator 14 and automatically turning off the alarm sound. Since the contents of the counters 7 and 8 are not cleared, the alarm sound is generated at the set time on every Tuesday.

Next, an explanation will be made on the action when the date and time, e.g., 10th, AM. 10:15, are set. In the same way as described above, the time "10:15, AM" is set to the counter 7 while the date "10" is set to the counter 8. As the counted output of the counters 4 and 6 become in conformity with the set time and date along with the passage of time, the output of the coincidence circuits 10, 11 becomes "1" and hence, the output of the gate circuit 23 becomes "1". Accordingly, the mono-multivibrator 12 produces a pulse and inverses the output Q of the flip-flop circuit 13 to "1", thereby actuating the alarm sound signal generator 14 to generate the alarm sound. The sound can be stopped manually in the same way as described already.

The output "1" of the flip-flop circuit 13 is held at "1" via the delay circuit 15. When the switch 37 is closed, therefore, the output of the gate circuit 26 becomes "1" and the input of the gate circuit 24 is held at "1". Since the date of the counter 8 is not "00", the output of the detection circuit 17 is "0" and hence, the output of the inverter 34 is "1". Furthermore, since the data other than those of the day of the week are set to the counter 8, the output of the inverter 35 is "1" and hence, the output of the gate circuit 24 becomes "1" thereby to reset the contents of the counters 7 and 8.

Further, an explanation will be made on the alarm sound generating action at a set time everyday. In this case, the counter 8 is set to "00" while a desired time is set to the counter 7, such as 6:10 AM, for examle, if the alarm sound is to be generated at that time. As the counter 8 is set to "00", the output of the detection circuit 17 becomes "1" and renders the input of the gate circuit 17 "0" and the input of the gate 24 "0" via the inverter 34. When the counter 4 counts the time "6:10, AM", the output "1" is produced on the coincidence circuit 10 and the output of the gate circuit 23 is inverted to "1". Thereafter, the same action as noted above is repeated with the proviso that "1" is produced on the output of the gate circuit 25 when the alarm sound from the speaker 14*a* is stopped by either manual operation of the generator or by the output "1" of the counter 16. Since the gate circuit 24 is kept closed, however, its output retains "0" so that the content of the counter 7 is not reset. Accordingly, when the counter 4 again counts the time "6:10 AM", the alarm sound is generated from the alarm sound signal generator 14 in exactly the same action as described above.

The foregoing embodiment illustrates the case where the alarm sound is repeatedly generated at the set time every day when the counter 8 is "00", that is, when the display section 21*b* is "00". In order to ensure easy recognition of its content, the output of the counter 8 may be subjected to code-conversion so that the abbreviation of "Automatic Alarm", i.e., "AA", may be displayed on the display section 21*b*. Further, the content of the counter 8 is not limited in particular to "00". In other words, it is possible to set a predetermined value and to bring the discrimination content of the detection circuit 17 into conformity with the value.

The foregoing explains the setting time of the date/day of the week as well as the set data "00". However, the invention is not restricted thereto, but it is also possible in accordance with the invention to display other items such as "ME", "AP" and the like that are abbreviations of meeting and appointment, respectively, by increasing the digit of the counter 8 and using the set data of the counter.

As described in detail in the foregoing paragraph, the present invention sets a scheduled time of at least either one of the date/day of the week and predetermined data, and displays the scheduled time. Hence, setting can be made rapidly without committing an error while confirming not only the display of the time but also that of the date/day of the week. Further, the circuit construction can be simplified in the invention as a number of alarms can be set using the same circuit construction.

Setting of the scheduled content is made on the basis of pulses generated in response to the manual operation. Hence, the setting action can be conducted rapidly with the simple construction. Further, as various alarms can be set in the same mode, the setting operation becomes simple.

When the alarm sound is to be generated repeatedly, it is possible to maintain the memory of the scheduled content even after the alarm sound is generated. When this repetition is not required, the scheduled content can be reset automatically so that resetting of the scheduled content is not necessary in the repeating operation. If the repeating operation is not necessary, it is not at all necessary to release the scheduled content on such operation. Hence, the invention provides the advantage in that once the scheduled content is set, it is no longer necessary to set such content once again or to release such content.

What is claimed is:

1. An electronic timepiece comprising:

a first counting circuit for counting time and at least one of date and the days of the week;

a first storage circuit for storing scheduled time and providing a corresponding output;

a first coincidence circuit for detecting the coincidence between time data from the first counting circuit and the output from the first storage circuit;

a second storage circuit for storing at least one from among data representative of the date, the days of the week and data consisting of a predetermined code and providing a corresponding output;

a second coincidence circuit for detecting the coincidence between the data from the second storage circuit and said at least one of date and the days of the week;

a display unit for displaying information representative of the output from the second storage circuit;

an alarm sound signal control means for controlling the occurrence of an alarm sound in response to both outputs of the first and second coincidence circuits;

means for effecting reset of the second storage circuit; and a control circuit for controlling the reset action of the first and second storage circuits in response to at least an alarm sound stop signal from the alarm sound signal control means.

2. An electronic timepiece according to claim 1, further including manually operable setting means for advancing the count of at least one of said first and second storage means in accordance with pulses developed in response to manual operation.

* * * * *